US009734837B2

(12) United States Patent
Oh et al.

(10) Patent No.: US 9,734,837 B2
(45) Date of Patent: Aug. 15, 2017

(54) METHOD, MEDIUM, AND SYSTEM SCALABLY ENCODING/DECODING AUDIO/SPEECH

(71) Applicant: SAMSUNG ELECTRONICS CO., LTD., Suwon-si (KR)

(72) Inventors: Eun-mi Oh, Seongnam-si (KR); Ho-sang Sung, Yongin-si (KR); Ki-hyun Choo, Seoul (KR); Kang-eun Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 13/645,834

(22) Filed: Oct. 5, 2012

(65) Prior Publication Data

US 2013/0030820 A1 Jan. 31, 2013

Related U.S. Application Data

(63) Continuation of application No. 11/984,686, filed on Nov. 20, 2007, now Pat. No. 8,285,555.

(30) Foreign Application Priority Data

Nov. 21, 2006 (KR) ..... 10-2006-0115523
Oct. 29, 2007 (KR) ..... 10-2007-0109158

(51) Int. Cl.
*G10L 19/24* (2013.01)

(52) U.S. Cl.
CPC ..... *G10L 19/24* (2013.01)

(58) Field of Classification Search
CPC ..... G10L 19/24; G10L 19/04; G10L 19/005
(Continued)

(56) References Cited

U.S. PATENT DOCUMENTS 5,970,443 A 10/1999 Fujii
6,266,644 B1 7/2001 Levine
(Continued)

FOREIGN PATENT DOCUMENTS

JP 03-263100 11/1991
JP 2005-121743 5/2005
WO 2004/027368 4/2004

OTHER PUBLICATIONS

PCT International Search Report issued Feb. 28, 2008 in corresponding International Application No. PCT/KR2007/005833.
(Continued)

*Primary Examiner* — Angela A Armstrong
(74) *Attorney, Agent, or Firm* — Staas & Halsey LLP

(57) ABSTRACT

A method, medium, and system scalably encoding/decoding audio/speech. The method includes splitting an input signal into a low frequency band signal that is lower than a predetermined frequency and a high frequency band signal that is higher than the predetermined frequency, scalably encoding the split low frequency band signal into a core layer and one or more extension layers and then decoding the encoded core layer and the encoded extension layers, generating an error signal by using the split low frequency band signal and a decoded signal of the encoded core layer and the encoded extension layers, and encoding the error signal and the high frequency band signal into a signal-to-noise ratio (SNR) enhancement layer and a bandwidth extension layer.

12 Claims, 14 Drawing Sheets

(58) Field of Classification Search
USPC ..... 704/200.1, 211, 500
See application file for complete search history.

(56) References Cited

U.S. PATENT DOCUMENTS

| | | | | |
|---|---|---|---|---|
| 6,772,114 | B1 | 8/2004 | Sluijter et al. | |
| 6,947,886 | B2 | 9/2005 | Rose et al. | |
| 7,277,849 | B2 * | 10/2007 | Streich et al. | 704/229 |
| 8,285,555 | B2 * | 10/2012 | Oh et al. | 704/500 |
| 2008/0052068 | A1 * | 2/2008 | Aguilar | G10L 19/093 704/230 |

OTHER PUBLICATIONS

Office Action mailed Jan. 3, 2012 in U.S. Appl. No. 11/984,686.
Notice of Allowance mailed Jun. 1, 2012 in U.S. Appl. No. 11/984,686.

* cited by examiner

METHOD, MEDIUM, AND SYSTEM SCALABLY ENCODING/DECODING AUDIO/SPEECH

CROSS-REFERENCE TO RELATED APPLICATIONS

This application is a continuation of U.S. application Ser. No. 11/984,686, filed Nov. 20, 2007, and claims the benefits of Korean Patent Application No. 10-2006-0115523, filed on Nov. 21, 2006, and Korean Patent Application No. 10-2007-0109158, filed on Oct. 29, 2007, in the Korean Intellectual Property Office, the disclosures of which are incorporated herein in their entirety by reference.

BACKGROUND

1. Field

One or more embodiments of the present invention relate to a method, medium, and system scalably encoding/decoding audio/speech, and more particularly, to a method, medium, and system scalably encoding/decoding audio/speech by using a bandwidth enhancement layer and a signal-to-noise ratio (SNR) enhancement layer.

2. Description of the Related Art

As application fields of audio communication diversify and transmission speeds of networks improve, demands for high-quality audio communication increase.

In a scalable structure, data of a bitstream may be formed of a plurality of layers. For example, a core layer may be composed of a minimum amount of required data and at least one enhancement layer may be composed of additional data that is usable to improve the sound quality of the core layer. In a bitstream having the above-described structure, if necessary, certain lower layers may be cut off by a bitstream cut-off module of a terminal or a network and only upper layers may be transmitted.

SUMMARY

One or more embodiments of the present invention provide a method, medium, and system scalably encoding audio/speech in which the sound quality of the audio/speech may be improved by scalably encoding the audio/speech.

One or more embodiments of the present invention also provide a method, medium, and system scalably decoding audio/speech in which the sound quality of the audio/speech may be improved by scalably decoding a result of an encoding of audio/speech.

Additional aspects and/or advantages will be set forth in part in the description which follows and, in part, will be apparent from the description, or may be learned by practice of the invention.

According to an aspect of the present invention, there is provided a method for scalably encoding an audio/speech signal, the method including splitting an input signal into a low frequency band signal that is lower than a predetermined frequency and a high frequency band signal that is higher than the predetermined frequency, scalably encoding the split low frequency band signal into a core layer and one or more extension layers and then decoding the encoded core layer and the encoded extension layers, generating an error signal by using the split low frequency band signal and a decoded signal of the encoded core layer and the encoded extension layers, and encoding the error signal and the high frequency band signal into a signal-to-noise ratio (SNR) enhancement layer and a bandwidth extension layer.

According to another aspect of the present invention, there is provided a method for scalably decoding an audio/speech signal, the method including scalably decoding results of encoding a core layer and one or more extension layers, which are included in an result of encoding an input signal, reconstructing an SNR enhancement signal and a bandwidth enhancement signal by decoding results of encoding an SNR enhancement layer and a bandwidth enhancement layer which are included in the result of encoding the input signal, generating an addition signal by adding the reconstructed SNR enhancement signal to a reconstructed signal of the core layer and the extension layers, and combining the addition signal and the bandwidth enhancement signal.

According to another aspect of the present invention there is provided a computer readable recording medium having recorded thereon a computer program for executing a method for scalably decoding an audio/speech signal, the method including scalably decoding results of encoding a core layer and one or more extension layers, which are included in an result of encoding an input signal, reconstructing an SNR enhancement signal and a bandwidth enhancement signal by decoding results of encoding an SNR enhancement layer and a bandwidth enhancement layer which are included in the result of encoding the input signal, generating an addition signal by adding the reconstructed SNR enhancement signal to a reconstructed signal of the core layer and the extension layers, and combining the addition signal and the bandwidth enhancement signal.

According to another aspect of the present invention there is provided a system for scalably encoding an audio/speech signal, the system including a band splitting unit for splitting an input signal into a low frequency band signal that is lower than a predetermined frequency and a high frequency band signal that is higher than the predetermined frequency, an extension encoder/decoder for scalably encoding the split low frequency band signal into a core layer and one or more extension layers and then decoding the encoded core layer and the encoded extension layers, an error signal generation unit for generating an error signal by using the split low frequency band signal and a decoded signal of the encoded core layer and the encoded extension layers, and an enhancement layer encoding unit for encoding the error signal and the high frequency band signal into a signal-to-noise ratio (SNR) enhancement layer and a bandwidth extension layer.

According to another aspect of the present invention there is provided a system for scalably decoding an audio/speech signal, the system including an extension decoder for scalably decoding results of encoding a core layer and one or more extension layers, which are included in an result of encoding an input signal, an enhancement layer decoding unit for reconstructing an SNR enhancement signal and a bandwidth enhancement signal by decoding results of encoding an SNR enhancement layer and a bandwidth enhancement layer which are included in the result of encoding the input signal, an addition unit for generating an addition signal by adding the reconstructed SNR enhancement signal to a reconstructed signal of the core layer and the extension layers, and a band combination unit for combining the addition signal and the bandwidth enhancement signal.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
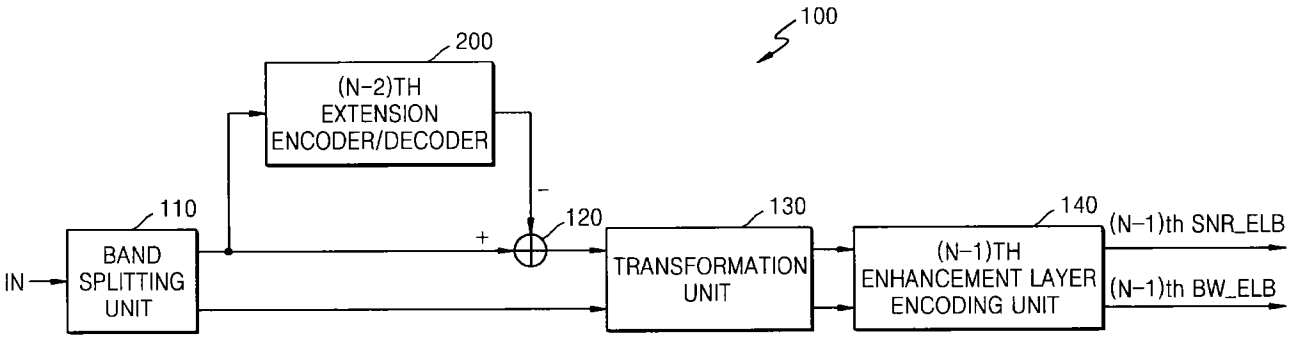
FIG. 1 illustrates a scalable encoding system, according to an embodiment of the present invention.

Reference will now be made in detail to embodiments, examples of which are illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

FIG. 1 illustrates a scalable encoding system 100, according to an embodiment of the present invention.

Referring to FIG. 1, the scalable encoding system 100 may include a band splitting unit 110, an error signal generation unit 120, a transformation unit 130, an (N-1)th enhancement layer encoding unit 140, and an (N-2)th extension encoder/decoder 200, for example.

The band splitting unit 110 may split an input signal into zeroth through (N-2)th bands, for example, corresponding to a low frequency band that is lower than a predetermined frequency, and an (N-1)th band corresponding to a high frequency band that is higher than the predetermined frequency.

Figure 2:
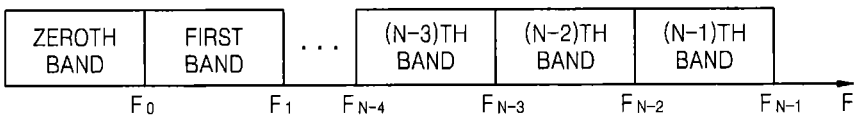
FIG. 2 illustrates an example of frequency bands that are split in accordance with a sampling frequency, according to an embodiment of the present invention.

FIG. 2 illustrates an example of frequency bands that are split in accordance with an example sampling frequency, according to an embodiment of the present invention.

Hereinafter, an example operation of the band splitting unit 110 will be described in further detail with reference to FIGS. 1 and 2.

The band splitting unit 110 may split an input signal by predetermined bandwidths in accordance with a sampling frequency. In more detail, for example, if the sampling frequency is $F_{N-2}$, the band splitting unit 110 may split the input signal into zeroth through (N-2)th bands corresponding to frequencies 0 through $F_{N-2}$, and an (N-1)th band corresponding to frequencies $F_{N-2}$ through $F_{N-1}$. For example, the band splitting unit 110 may split the input signal into a low frequency band and a high frequency band by using a quadrature mirror filterbank (QMF) method, noting alternative embodiments are also available.

According to another embodiment of the present invention, the band splitting unit 110 may previously split an input signal into a plurality of frequency bands required for all extension encoders included in the scalable encoding system 100, and may output a plurality of band signals.

Referring back to FIG. 1, here, the (N-2)th extension encoder/decoder 200 encodes a signal of the zeroth through (N-2)th bands which are split by the band splitting unit 110.

Figure 3:
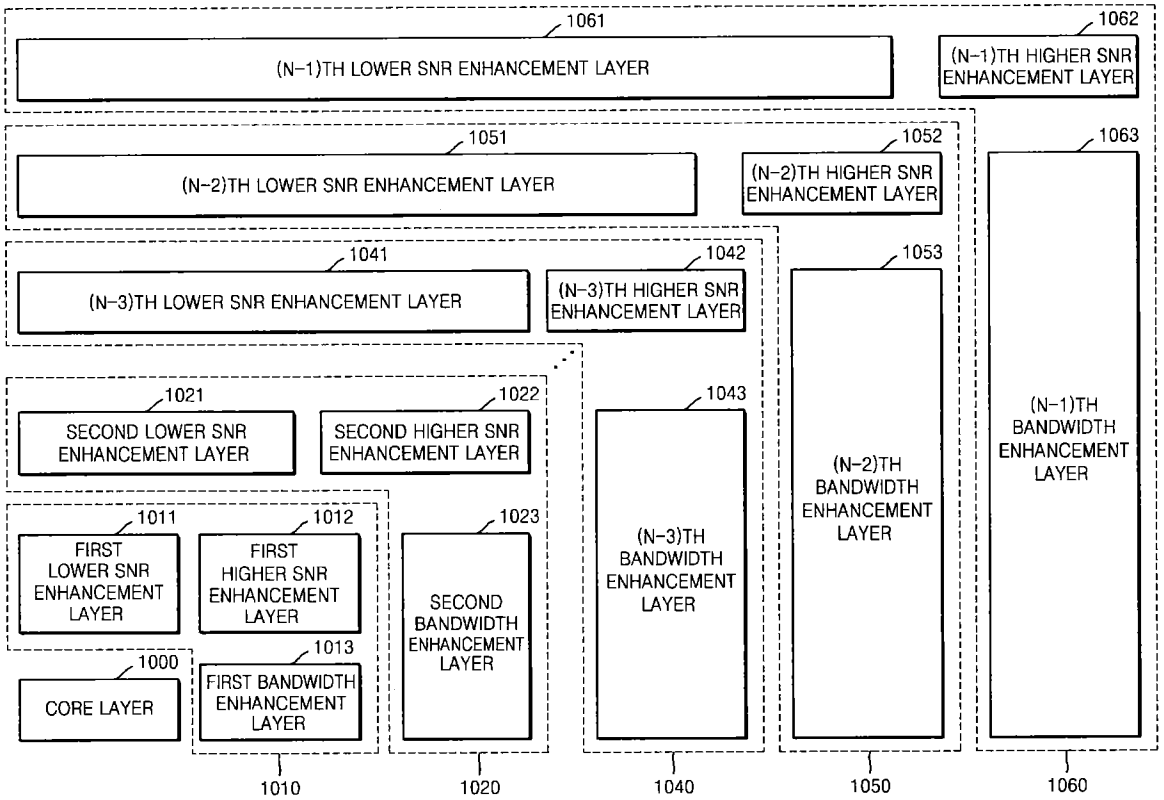
FIG. 3 illustrates an example scalable structure of the scalable encoding system illustrated in FIG. 1, according to an embodiment of the present invention.

FIG. 3 illustrates a scalable structure of the scalable encoding system 100 illustrated in FIG. 1, according to an embodiment of the present invention.

Hereinafter, an example operation of the (N-2)th extension encoder/decoder 200 illustrated in FIG. 1 will be described in further detail with reference to FIGS. 1 and 3, noting that embodiments of the present invention are not limited to the same.

The (N-2)th extension encoder/decoder 200 may scalably encode a signal of zeroth through (N-2)th bands which are split by the band splitting unit 110 into, as shown in FIG. 3, an example core layer 1000 and first through (N-2)th extension layers 1010, 1020, 1030, 1040, and 1050 by using the scalability of a bandwidth and a signal-to-noise ratio (SNR). Then, the (N-2)th extension encoder/decoder 200 decodes a result of encoding the shown core layer 1000 and the first through (N-2)th extension layers 1010, 1020, 1030, 1040, and 1050. Operations of the (N-2)th extension encoder/decoder 200 will be described in further detail below with reference to FIG. 4.

Here, again referring to FIGS. 1 and 3, the core layer 1000 may correspond to a predetermined frequency band of the input signal.

In addition, the first extension layer 1010 may include, as show in FIG. 3, a first lower SNR enhancement layer 1011, a first higher SNR enhancement layer 1012, and a first bandwidth enhancement layer 1013, for example.

Here, in this example, the first bandwidth enhancement layer 1013 corresponds to a frequency band higher than the core layer 1000. As such, if the first bandwidth enhancement layer 1013 is used, the sound quality of a signal to be output may be improved by extending bandwidths. In addition, the first lower SNR enhancement layer 1011 corresponds to an error signal generated by subtracting a signal that is obtained by decoding a result of encoding the core layer 1000, from a signal of the core layer 1000. The first higher SNR enhancement layer 1012 corresponds to an error signal generated by subtracting a signal that is obtained by decoding a result of encoding the first bandwidth enhancement layer 1013, from a signal of the first bandwidth enhancement layer 1013. As such, if the first lower SNR enhancement layer 1011 and the first higher SNR enhancement layer 1012 are used, quantization noise may be reduced and the sound quality of a signal to be output may be improved by improving the SNR.

Likewise, as further shown in FIG. 3, the second extension layer 1020 may include a second lower SNR enhancement layer 1021, a second higher SNR enhancement layer 1022, and a second bandwidth enhancement layer 1023. The (N-3)th extension layer 1040 may include an (N-3)th lower SNR enhancement layer 1041, an (N-3)th higher SNR enhancement layer 1042, and an (N-3)th bandwidth enhancement layer 1043. The (N-2)th extension layer 1050 may include an (N-2)th lower SNR enhancement layer 1051, an (N-2)th higher SNR enhancement layer 1052, and an (N-2)th bandwidth enhancement layer 1053. The (N-1)th extension layer 1060 may include an (N-1)th lower SNR enhancement layer 1061, an (N-1)th higher SNR enhancement layer 1062, and an (N-1)th bandwidth enhancement layer 1063.

As shown in FIG. 1, the error signal generation unit 120 may extract an (N-1)th error signal by using the signal of the zeroth through (N-2)th bands which are split by the band splitting unit 110 and a result of decoding the core layer 1000 and the first through (N-2)th extension layers 1010, 1020, 1030, 1040, and 1050, which is output from the (N-2)th extension encoder/decoder 200. In more detail, the error signal generation unit 120 may extract the (N-1)th error signal by subtracting the result of decoding the core layer 1000 and the first through (N-2)th extension layers 1010, 1020, 1030, 1040, and 1050, which is output from the (N-2)th extension encoder/decoder 200, from the signal of the zeroth through (N-2)th bands which are split by the band splitting unit 110.

The transformation unit 130 may transform a signal of the (N-1)th band split by the band splitting unit 110 and the (N-1)th error signal extracted by the error signal generation unit 120 from the time domain to the frequency domain. For example, the transformation unit 130 may perform modified discrete cosine transformation (MDCT) on the signal of the (N-1)th band split by the band splitting unit 110 and the (N-1)th error signal extracted by the error signal generation unit 120 so as to transform the signal of the (N-1)th band and the (N-1)th error signal from the time domain to the frequency domain.

The (N-1)th enhancement layer encoding unit 140 may encode the signal of the (N-1)th band which is transformed by the transformation unit 130 into the (N-1)th higher SNR enhancement layer 1062 and the (N-1)th bandwidth enhancement layer 1063 and encode the (N-1)th error signal which is transformed by the transformation unit 130 to the (N-1)th lower SNR enhancement layer 1061. In more detail, the (N-1)th enhancement layer encoding unit 140 may encode the (N-1)th higher SNR enhancement layer 1062 and the (N-1)th bandwidth enhancement layer 1063 by using the (N-1)th error signal which is transformed by the transformation unit 130. Here, the (N-1)th enhancement layer encoding unit 140 outputs an encoding result (N-1)th SNR_ELB (Enhancement Layer Bitstream) of an (N-1)th SNR enhancement layer which includes an encoding result of the (N-1)th lower SNR enhancement layer 1061 and the (N-1)th higher SNR enhancement layer 1062, and an encoding result (N-1)th BW (BandWidth)_ELB of the (N-1)th bandwidth enhancement layer 1063, as an output bitstream.

Figure 4:
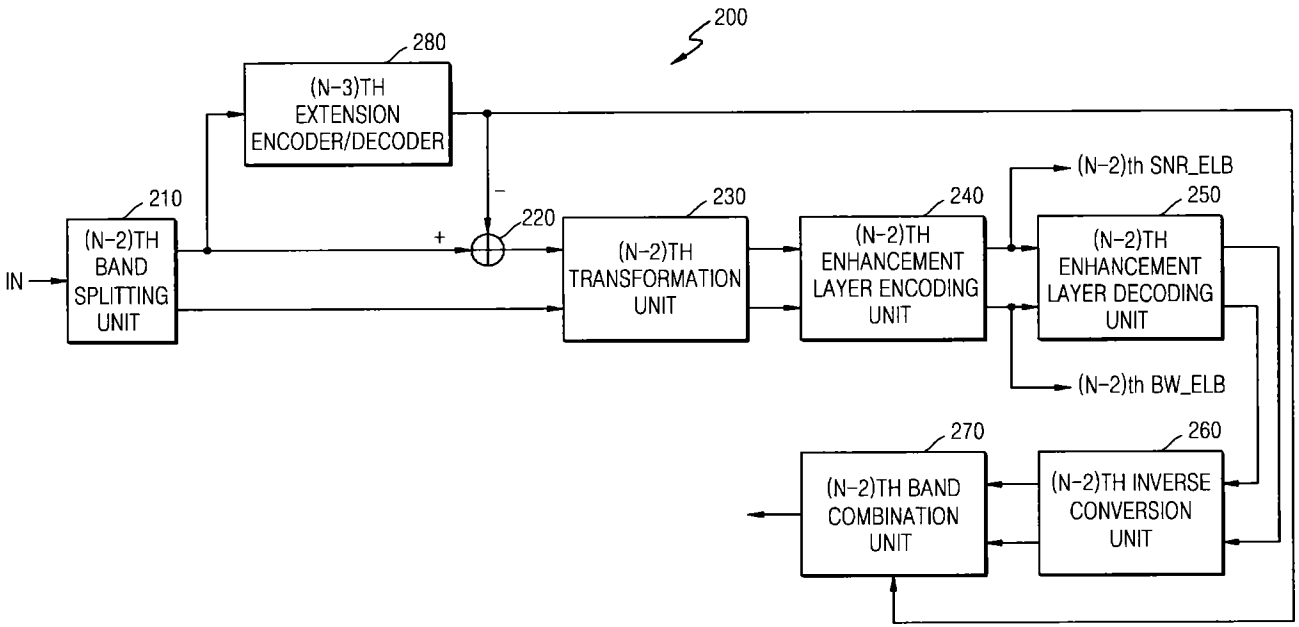
FIG. 4 illustrates an (N-2)th extension encoder/decoder, such as that illustrated in FIG. 1, according to an embodiment of the present invention.

FIG. 4 illustrates such a (N-2)th extension encoder/decoder 200 as illustrated in FIG. 1, according to an embodiment of the present invention. Below, FIG. 4 will be described in conjunction with FIG. 3, noting that embodiments of the present invention are not limited to the same.

Referring to FIG. 4, the (N-2)th extension encoder/decoder 200 may include an (N-2)th band splitting unit 210, an (N-2)th error signal generation unit 220, an (N-2)th transformation unit 230, an (N-2)th enhancement layer encoding unit 240, an (N-2)th enhancement layer decoding unit 250, an (N-2)th inverse transformation unit 260, an (N-2)th band combination unit 270, and an (N-3)th extension encoder/decoder 280, for example.

Here, the (N-2)th band splitting unit 210 splits an input signal into zeroth through (N-3)th bands corresponding to a low frequency band that is lower than a predetermined frequency and an (N-2)th band corresponding to a high frequency band that is higher than the predetermined frequency. Here, for example, the input signal may be a signal of the zeroth through (N-2)th bands which are split by the band splitting unit 110 illustrated in FIG. 1.

In more detail, referring again to FIGS. 2 and 4, if a sampling frequency is $F_{N-3}$, the (N-2)th band splitting unit 210 may split the input signal into the zeroth through (N-3)th bands corresponding to frequencies zero through $F_{N-3}$, and the (N-2)th band corresponding to frequencies $F_{N-3}$ through $F_{N-2}$. For example, the (N-2)th band splitting unit 210 may split the input signal into the low frequency band and the high frequency band by using a QMF method, noting that alternative embodiments are also available.

The (N-3)th extension encoder/decoder 280 may encode a signal of the zeroth through (N-3)th bands that are split by the (N-2)th band splitting unit 210 into the core layer 1000 and the first through (N-3)th extension layers 1010, 1020, 1030, and 1040, for example. Then, the (N-3)th extension encoder/decoder 280 decodes a result of encoding the core layer 1000 and the first through (N-3)th extension layers 1010, 1020, 1030, and 1040.

Here, in this example, the (N-2)th error signal generation unit 220 extracts an (N-2)th error signal by using the signal of the zeroth through (N-3)th bands which are split by the (N-2)th band splitting unit 210 and a result of decoding the core layer 1000 and the first through (N-3)th extension layers 1010, 1020, 1030, and 1040, which is output from the (N-3)th extension encoder/decoder 280. In more detail, the (N-2)th error signal generation unit 220 may extract the (N-2)th error signal by subtracting the result of decoding the core layer 1000 and the first through (N-3)th extension layers 1010, 1020, 1030, and 1040, which is output from the (N-3)th extension encoder/decoder 280, from the signal of the zeroth through (N-3)th bands which are split by the (N-2)th band splitting unit 210.

The (N-2)th transformation unit 230 transforms a signal of the (N-2)th band that is split by the (N-2)th band splitting unit 210 and the (N-2)th error signal extracted by the (N-2)th error signal generation unit 220 from the time domain to the frequency domain.

The (N-2)th enhancement layer encoding unit 240 may encode the signal of the (N-2)th band which is transformed by the (N-2)th transformation unit 230 into the (N-2)th higher SNR enhancement layer 1052 and the (N-2)th bandwidth enhancement layer 1053 and encode the (N-2)th error signal which is transformed by the (N-2)th transformation unit 230 into the (N-2)th lower SNR enhancement layer 1051, for example. In more detail, the (N-2)th enhancement layer encoding unit 240 may encode the (N-2)th higher SNR enhancement layer 1052 and the (N-2)th bandwidth enhancement layer 1053 by using the (N-2)th error signal which is transformed by the (N-2)th transformation unit 230. Here, the (N-2)th enhancement layer encoding unit 240 outputs an encoding result (N-2)th SNR_ELB of an (N-2)th SNR enhancement layer which includes an encoding result of the (N-2)th lower SNR enhancement layer 1051 and the (N-2)th higher SNR enhancement layer 1052, and an encoding result (N-2)th BW_ELB of the (N-2)th bandwidth enhancement layer 1053 as an output bitstream.

The (N-2)th enhancement layer decoding unit 250 may decode the encoding result (N-2)th SNR_ELB and the encoding result (N-2)th BW_ELB which are output from the (N-2)th enhancement layer encoding unit 240.

The (N-2)th inverse transformation unit 260 may further inversely transform a signal decoded by the (N-2)th enhancement layer decoding unit 250 from the frequency domain to the time domain.

The (N-2)th band combination unit 270 may then combine a signal decoded by the (N-3)th extension encoder/decoder 280 and a signal inversely transformed by the (N-2)th inverse transformation unit 260. For example, the (N-2)th band combination unit 270 may combine the signals by using an inverse quadrature mirror filterbank (IQMF) method, noting that alternatives are also available.

Figure 5:
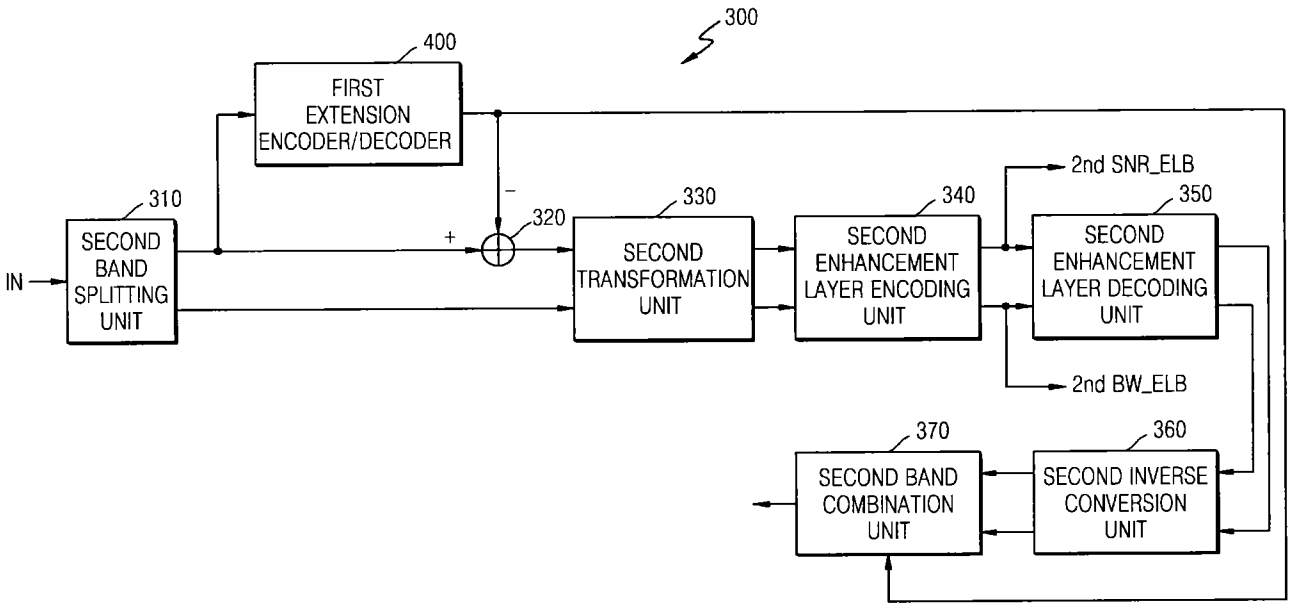
FIG. 5 illustrates a second extension encoder/decoder, according to an embodiment of the present invention.

FIG. 5 illustrates a second extension encoder/decoder 300, according to an embodiment of the present invention. Below, FIG. 5 will be described in conjunction with FIG. 3, noting that embodiments of the present invention are not limited to the same.

Referring to FIG. 5, the second extension encoder/decoder 300 may include a second band splitting unit 310, a second error signal generation unit 320, a second transformation unit 330, a second enhancement layer encoding unit 340, a second enhancement layer decoding unit 350, a second inverse transformation unit 360, a second band combination unit 370, and a first extension encoder/decoder 400, for example.

The second band splitting unit 310 may split an input signal into zeroth and first bands corresponding to a low frequency band that is lower than a predetermined frequency and a second band corresponding to a high frequency band that is higher than the predetermined frequency, for example. Here, in this example, the input signal may be a signal of the zeroth through second bands which are split by a third band splitting unit (not shown).

In more detail, referring to FIGS. 2 and 5, if a sampling frequency is $F_1$, for example, the second band splitting unit 310 may split the input signal into the zeroth and first bands corresponding to frequencies zero through $F_1$, and the second band corresponding to frequencies $F_1$ through $F_2$. For example, the second band splitting unit 310 may split the input signal into the low frequency band and the high frequency band by using a QMF method, noting that alternatives are also available.

The first extension encoder/decoder 400 may encode a signal of the zeroth and first bands that are split by the second band splitting unit 310 into the core layer 1000 and the first extension layer 1010. Then, the first extension encoder/decoder 400 may decode a result of encoding the core layer 1000 and the first extension layer 1010.

The second error signal generation unit 320 may extract a second error signal by using the signal of the zeroth and first bands which are split by the second band splitting unit 310 and a result of decoding the core layer 1000 and the first extension layer 1010, which is output from the first extension encoder/decoder 400. In more detail, in this example, the second error signal generation unit 320 may extract the second error signal by subtracting the result of decoding the core layer 1000 and the first extension layer 1010 which is output from the first extension encoder/decoder 400, from the signal of the zeroth and first bands which are split by the second band splitting unit 310.

The second transformation unit 330 transforms a signal of the second band that is split by the second band splitting unit 310 and the second error signal extracted by the second error signal generation unit 320 from the time domain to the frequency domain.

The second enhancement layer encoding unit 340 encodes the signal of the second band which is transformed by the second transformation unit 330 into the second higher SNR enhancement layer 1022 and the second bandwidth enhancement layer 1023 and encodes the second error signal which is transformed by the second transformation unit 330 into the second lower SNR enhancement layer 1021. In more detail, in this example, the second enhancement layer encoding unit 340 may encode the second higher SNR enhancement layer 1022 and the second bandwidth enhancement layer 1023 by using the second error signal which is transformed by the second transformation unit 330. Here, the second enhancement layer encoding unit 340 outputs an encoding result $2^{nd}$ SNR_ELB of a second SNR enhancement layer which includes a result of encoding the second lower SNR enhancement layer 1021 and the second higher SNR enhancement layer 1022, and an encoding result $2^{nd}$ BW_ELB of the second bandwidth enhancement layer 1023 as an output bitstream.

Further, in this example, the second enhancement layer decoding unit 350 decodes the encoding result $2^{nd}$ SNR_ELB and the encoding result $2^{nd}$ BW_ELB which are output from the second enhancement layer encoding unit 340.

The second inverse transformation unit 360 inversely transforms a signal decoded by the second enhancement layer decoding unit 350 from the frequency domain to the time domain.

The second band combination unit 370 combines a signal decoded by the first extension encoder/decoder 400 and a signal inversely transformed by the second inverse transformation unit 360. For example, the second band combination unit 370 may combine the signals by using an IQMF method, noting that alternatives are also available.

Figure 6:
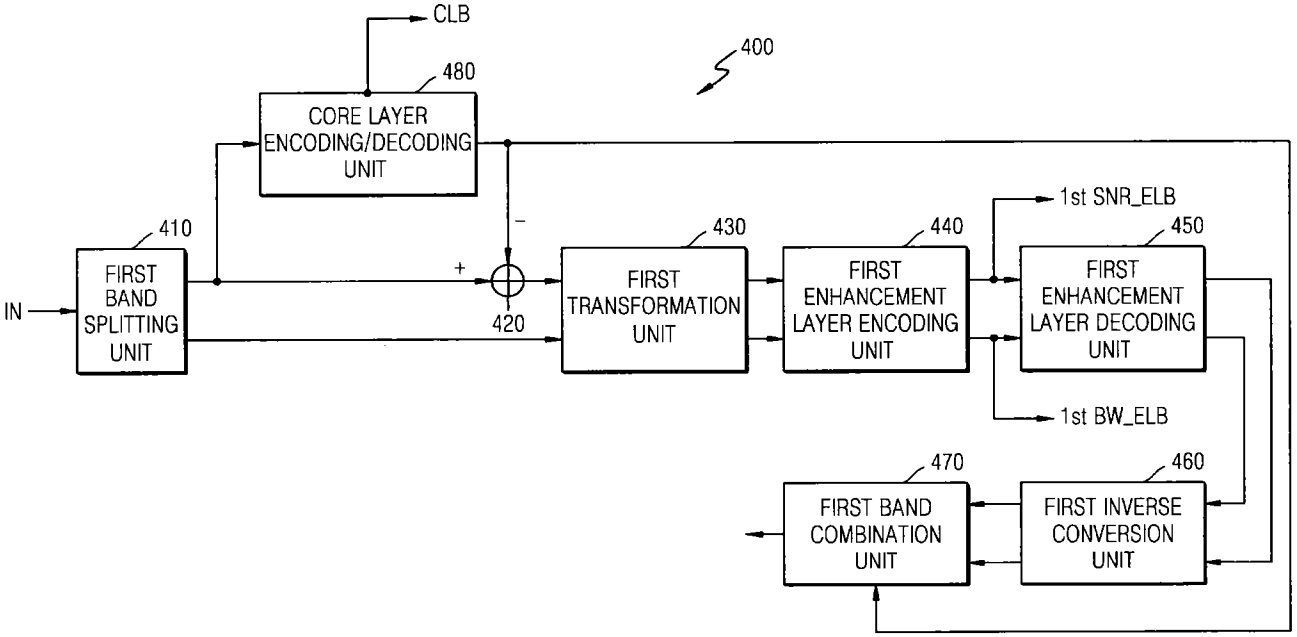
FIG. 6 illustrates a first extension encoder/decoder, such as that illustrated in FIG. 5, according to an embodiment of the present invention.

FIG. 6 illustrates such a first extension encoder/decoder 400 as illustrated in FIG. 5, according to an embodiment of the present invention. Below, FIG. 6 will be described in conjunction with FIG. 3, noting that embodiments of the present invention are not limited to the same.

Referring to FIG. 6, the first extension encoder/decoder 400 may include a first band splitting unit 410, a first error signal generation unit 420, a first transformation unit 430, a first enhancement layer encoding unit 440, a first enhancement layer decoding unit 450, a first inverse transformation unit 460, a first band combination unit 470, and a core layer encoding/decoding unit 480, for example.

Here, in this example, the first band splitting unit 410 splits an input signal into a zeroth band corresponding to a low frequency band that is lower than a predetermined frequency and a first band corresponding to a high frequency band that is higher than the predetermined frequency. Further, in this example, the input signal may be a signal of the zeroth through first bands which are split by the second band splitting unit 310 illustrated in FIG. 2.

In more detail, referring to FIGS. 2 and 6, if a sampling frequency is $F_0$, for example, the first band splitting unit 410 may split the input signal into the zeroth band corresponding to frequencies zero through $F_0$, and the first band corresponding to frequencies $F_0$ through $F_1$. For example, the first band splitting unit 410 may split the input signal into the low frequency band and the high frequency band by using a QMF method. For example, the frequency $F_0$ may be 8 kilohertz (kHz) and the frequency $F_1$ may be 16 kHz. In this case, the zeroth band corresponds to frequencies 0 kHz through 8 kHz and the first band corresponds to frequencies 8 kHz through 16 kHz, noting that alternatives are also available.

The core layer encoding/decoding unit 480 may encode a signal of the zeroth band that is split by the first band splitting unit 410 into the core layer 1000 so as to output an encoding result CLB (Core Layer Bitstream) of the core layer 1000, as an output bitstream, for example. Then, the core layer encoding/decoding unit 480 decodes the encoding result CLB of the core layer 1000.

Here, the first error signal generation unit 420 extracts a first error signal by using the signal of the zeroth band which is split by the first band splitting unit 410 and a result of decoding the core layer 1000 which is output from the core layer encoding/decoding unit 480. In more detail, in this example, the first error signal generation unit 420 may extract the first error signal by subtracting the result of decoding the core layer 1000 which is output from the core layer encoding/decoding unit 480, from the signal of the zeroth band which is split by the first band splitting unit 410.

The first transformation unit 430 may transform a signal of the first band that is split by the first band splitting unit 410 and the first error signal extracted by the first error signal generation unit 420 from the time domain to the frequency domain.

The first enhancement layer encoding unit 440 may then encode the signal of the first band which is transformed by the first transformation unit 430 into the first higher SNR enhancement layer 1012 and the first bandwidth enhancement layer 1013 and encode the first error signal which is transformed by the first transformation unit 430 into the first lower SNR enhancement layer 1011. In more detail, in this example, the first enhancement layer encoding unit 440 may encode the first higher SNR enhancement layer 1012 and the first bandwidth enhancement layer 1013 by using the first error signal which is transformed by the first transformation unit 430. Here, the first enhancement layer encoding unit 440 outputs an encoding result $1^{st}$ SNR_ELB of a first SNR enhancement layer which includes a result of encoding the first lower SNR enhancement layer 1011 and the first higher SNR enhancement layer 1012, and an encoding result $1^{st}$ BW_ELB of the first bandwidth enhancement layer 1013 as an output bitstream.

The first enhancement layer decoding unit 450 decodes the encoding result $1^{st}$ SNR_ELB and the encoding result $1^{st}$ BW_ELB which are output from the first enhancement layer encoding unit 440.

The first inverse transformation unit 460 inversely transforms a signal decoded by the first enhancement layer decoding unit 450 from the frequency domain to the time domain.

The first band combination unit 470 combines a signal decoded by the core layer encoding/decoding unit 480 and a signal inversely transformed by the first inverse transformation unit 460. For example, the first band combination unit 470 may combine the signals by using an IQMF method, noting that alternatives are also available.

As described above, a scalable encoding system scalably encoding audio/speech, according to one or more embodiments of the present invention, may include a band splitting unit, an extension encoder/decoder, an error signal generation unit, a transformation unit, and an enhancement layer encoding unit. In at least one case, the extension encoder/decoder may encode a signal of a low frequency band that is split by the band splitting unit into a core layer and a plurality of extension layers. Thus, the scalable encoding system may have a scalable structure as illustrated in FIGS. 4 through 6.

Figure 7:
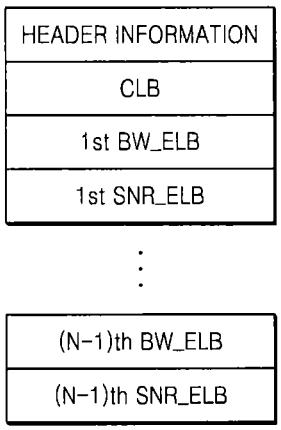
FIG. 7 illustrates an example of a bitstream output from a scalable encoding system, according to an embodiment of the present invention.

FIG. 7 illustrates an example of a bitstream output from a scalable encoding system, according to an embodiment of the present invention.

Referring to FIG. 7, the shown bitstream includes header information, an encoding result CLB of a core layer, an encoding result $1^{st}$ BW_ELB of a first bandwidth enhancement layer, an encoding result $1^{st}$ SNR_ELB of a first SNR enhancement layer, through to an encoding result (N-1)th BW_ELB of an (N-1)th bandwidth enhancement layer, and an encoding result (N-1)th SNR_ELB of an (N-1)th SNR enhancement layer, which may be arranged in the order as illustrated in FIG. 1, for example.

Here, the encoding result CLB of the core layer may be output from the core layer encoding/decoding unit 480 of the first extension encoder/decoder 400 illustrated in FIG. 6. The encoding result $1^{st}$ BW_ELB of the first bandwidth enhancement layer and the encoding result $1^{st}$ SNR_ELB of the first SNR enhancement layer may be output from the first enhancement layer encoding unit 440 of the first extension encoder/decoder 400 illustrated in FIG. 6. The encoding result (N-1)th BW_ELB of the (N-1)th bandwidth enhancement layer and the encoding result (N-1)th SNR_ELB of the (N-1)th SNR enhancement layer may be output from the (N-1)th enhancement layer encoding unit 140 of the scalable encoding system 100 illustrated in FIG. 1.

Figure 8:
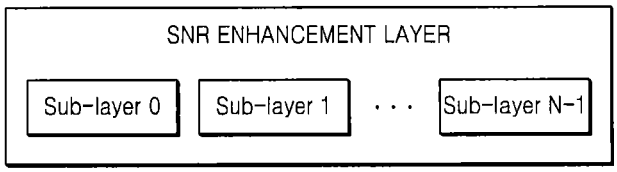
FIG. 8 illustrates a result of encoding a signal-to-noise ratio (SNR) enhancement layer output from a scalable encoding system, according to an embodiment of the present invention.

FIG. 8 illustrates a result of encoding an SNR enhancement layer output from a scalable encoding system, according to an embodiment of the present invention.

As illustrated in FIG. 7, the shown bitstream output from the scalable encoding system includes an encoding result $1^{st}$ SNR_ELB of a first SNR enhancement layer through to an encoding result (N-1)th SNR_ELB of an (N-1)th SNR enhancement layer. Such a result of encoding the SNR enhancement layer may be divided into a plurality of sub-layers 0 through N-1 as illustrated in FIG. 8 and the sub-layers 0 through N-1 may be combined in different ways. Here, the sub-layers 0 through N-1 are data included in the SNR enhancement layer which is divided into frequency bands.

Figure 9A:
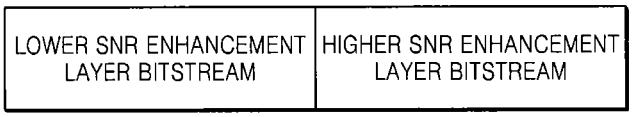
FIGS. 9A and 9B illustrate structural examples of a result of encoding an SNR enhancement layer output from a scalable encoding system, according to an embodiment of the present invention.
Figure 9B:
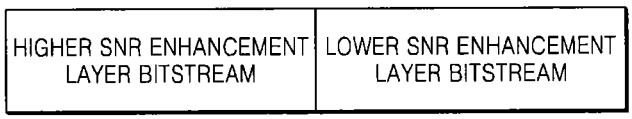

FIGS. 9A and 9B illustrates structural examples of a result of encoding an SNR enhancement layer output from a scalable encoding system, according to an embodiment of the present invention.

Referring to FIG. 9A, the SNR enhancement layer may be composed in an order from a lower SNR enhancement layer to a higher SNR enhancement layer, for example. Referring to FIG. 9B, the SNR enhancement layer may also be composed in an order from a higher SNR enhancement layer to a lower SNR enhancement layer.

Figure 10A:
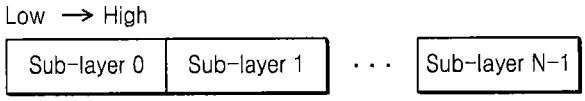
FIGS. 10A through 10C illustrate structural examples of each of a lower SNR enhancement layer and a higher SNR enhancement layer included in a result of encoding an SNR enhancement layer output from a scalable encoding system, according to an embodiment of the present invention.
Figure 10B:
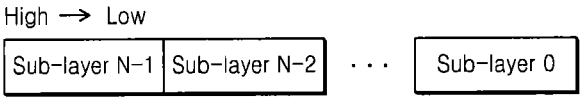
Figure 10C:
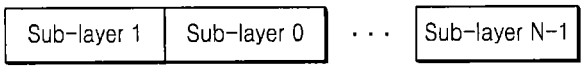

FIGS. 10A through 10C illustrates structural examples of each of a lower SNR enhancement layer and a higher SNR enhancement layer included in a result of encoding an SNR enhancement layer output from a scalable encoding system, according to an embodiment of the present invention.

Referring to FIG. 10A, each of the lower SNR enhancement layer and the higher SNR enhancement layer may be composed in an order from a sub-layer corresponding to a low frequency band to a sub-layer corresponding to a high frequency band, for example, in an order of a zeroth sub-layer, a first sub-layer, through to an (N-1)th sub-layer.

Referring to FIG. 10B, each of the lower SNR enhancement layer and the higher SNR enhancement layer may alternately be composed in an order from a sub-layer corresponding to a high frequency band to a sub-layer corresponding to a low frequency band, for example, in an order of an (N-1)th sub-layer, an (N-2)th sub-layer, through to a zeroth sub-layer, noting that further alternatives may also be available.

Referring to FIG. 10C, if information to be used is transmitted from an extension encoder/decoder corresponding to a relatively low frequency band, for example, if the information to be used is transmitted from a first extension encoder/decoder, each of the lower SNR enhancement layer and the higher SNR enhancement layer may be composed in an order of a first sub-layer, a zeroth sub-layer, through to an (N-1)th sub-layer.

Figure 11:
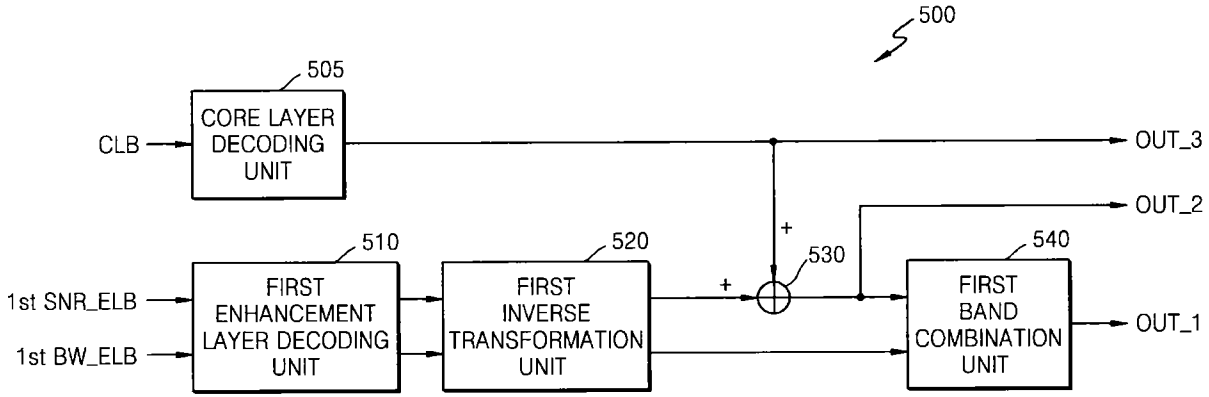
FIG. 11 illustrates a first extension decoder, according to an embodiment of the present invention.

FIG. 11 illustrates a first extension decoder 500, according to an embodiment of the present invention. Below, FIG. 11 will be described in conjunction with FIG. 3, noting that embodiments of the present invention are not limited to the same.

Referring to FIG. 11, the first extension decoder 500 may include a core layer decoding unit 505, a first enhancement layer decoding unit 510, a first inverse transformation unit 520, a first addition unit 530, and a first band combination unit 540, for example.

The core layer decoding unit 505 may decode an encoding result CLB of the core layer 1000 so as to output a reconstructed signal OUT_3 of the core layer 1000, shown in FIG. 3. For example, if the core layer 1000 corresponds to frequencies 0 kHz through 8 kHz, the reconstructed signal OUT_3 may be a signal corresponding to the frequencies 0 kHz through 8 kHz, noting that alternatives are also available.

The first enhancement layer decoding unit 510 decodes an encoding result $1^{st}$ SNR_ELB of the first lower SNR enhancement layer 1011 and the first higher SNR enhancement layer 1012, and an encoding result $1^{st}$ BW_ELB of the first bandwidth enhancement layer 1013, which are included in the first extension layer 1010, so as to output a first SNR enhancement signal and a first bandwidth enhancement signal.

The first inverse transformation unit 520 inversely transforms the first SNR enhancement signal and the first bandwidth enhancement signal decoded by the first enhancement layer decoding unit 510 from the frequency domain to the time domain.

The first addition unit 530 adds the first SNR enhancement signal inversely transformed by the first inverse transformation unit 520 to the reconstructed signal OUT_3 of the core layer 1000 which is output from the core layer decoding unit 505, so as to output a first addition signal OUT_2. For example, if the core layer 1000 corresponds to frequencies 0 kHz through 8 kHz, the first addition signal OUT_2 may be a signal which corresponds to the frequencies 0 kHz through 8 kHz and in which an SNR is enhanced, noting that alternatives are also available.

The first band combination unit 540 combines the first bandwidth enhancement signal inversely transformed by the first inverse transformation unit 520 and the first addition signal OUT_2 output from the first addition unit 530 so as to output a first enhancement signal OUT_1. For example, if the first bandwidth enhancement layer 1013 corresponds to frequencies 8 kHz through 16 kHz, the first enhancement signal OUT_1 may be a signal which corresponds to frequencies 0 kHz through 16 kHz and in which a bandwidth and an SNR are enhanced, again noting that alternatives are also available.

Figure 12:
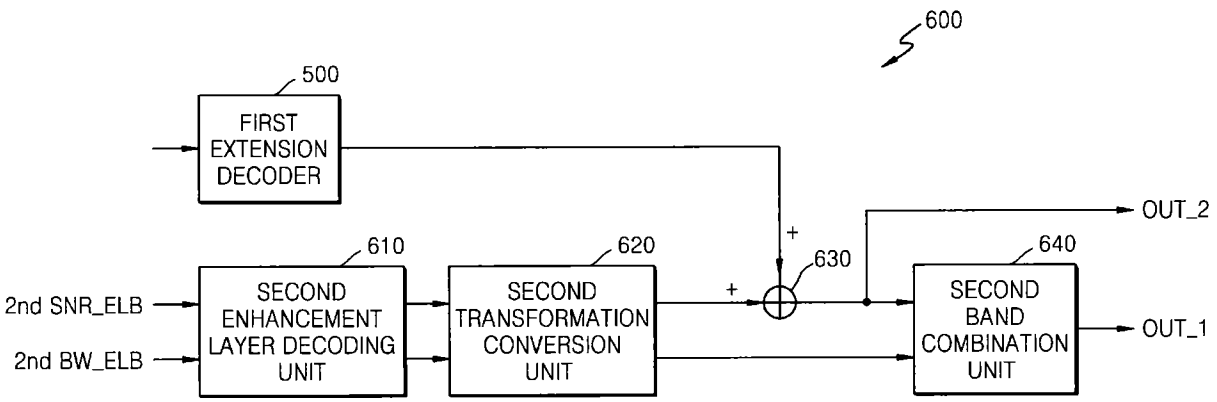
FIG. 12 illustrates a second extension decoder, according to an embodiment of the present invention.

FIG. 12 illustrates a second extension decoder 600, according to an embodiment of the present invention. Below, FIG. 12 will also be described in conjunction with FIG. 3, noting that embodiments of the present invention are not limited to the same.

Referring to FIG. 12, the second extension decoder 600 may includes a first extension decoder 500, a second enhancement layer decoding unit 610, a second inverse transformation unit 620, a second addition unit 630, and a second band combination unit 640, for example.

As illustrated in FIG. 11, the first extension decoder 500 decodes an encoding result CLB of the core layer 1000, shown in FIG. 3, and a result of encoding the first extension layer 1020. For example, the first extension decoder 500 may output a signal which corresponds to frequencies 1 kHz through 16 kHz and in which a bandwidth and an SNR are enhanced, noting that alternatives are also available.

As shown, the second enhancement layer decoding unit 610 decodes an encoding result $2^{nd}$ SNR_ELB of the second lower SNR enhancement layer 1021 and the second higher SNR enhancement layer 1022, and an encoding result $2^{nd}$ BW_ELB of the second bandwidth enhancement layer 1023, which are included in the second extension layer 1020, so as to output a second SNR enhancement signal and a second bandwidth enhancement signal.

The second inverse transformation unit 620 inversely transforms the second SNR enhancement signal and the second bandwidth enhancement signal decoded by the second enhancement layer decoding unit 610 from the frequency domain to the time domain.

The second addition unit 630 adds the second SNR enhancement signal inversely transformed by the second inverse transformation unit 620 to the reconstructed signal output from the first extension decoder 500, so as to output a second addition signal OUT_2. For example, if the first extension decoder 500 outputs the reconstructed signal corresponding to frequencies 0 kHz through 16 kHz, the second addition signal OUT_2 may be a signal which corresponds to the frequencies 0 kHz through 16 kHz and in which an SNR is further enhanced, noting again that alternatives are also available.

The second band combination unit 640 combines the second bandwidth enhancement signal inversely transformed by the second inverse transformation unit 620 and the second addition signal OUT_2 output from the second addition unit 630 so as to output a second enhancement signal OUT_1. For example, if the second bandwidth enhancement layer 1023 corresponds to example frequencies 16 kHz through 32 kHz, the second enhancement signal OUT_1 may be a signal which corresponds to example frequencies 0 kHz through 32 kHz and in which a bandwidth and an SNR are enhanced. For example, the second band combination unit 640 may combine the second bandwidth enhancement signal and the second addition signal OUT_2 by using an IQMF method, noting that alternatives are also available.

Figure 13:
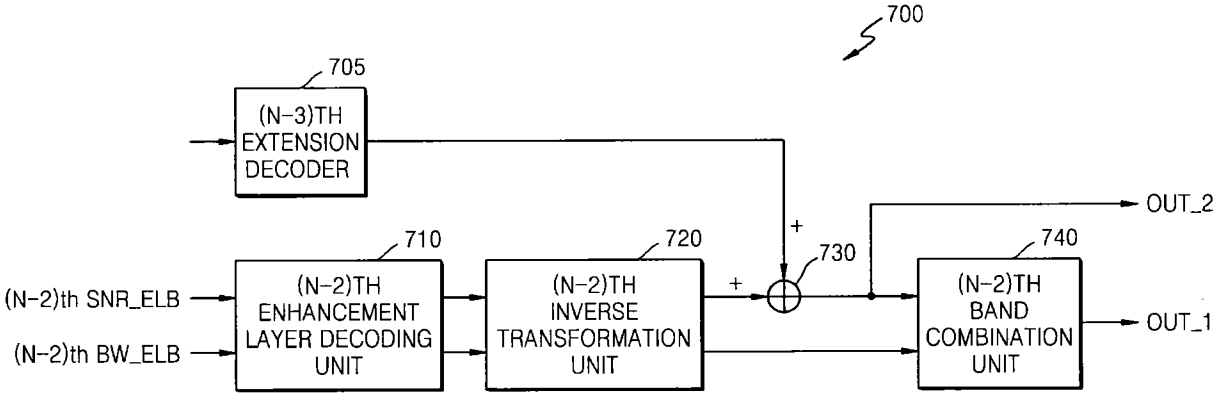
FIG. 13 illustrates an (N-2)th extension decoder, according to an embodiment of the present invention.

FIG. 13 illustrates an (N-2)th extension decoder 700, according to an embodiment of the present invention. Below, FIG. 13 will also be described in conjunction with FIG. 3, noting that embodiments of the present invention are not limited to the same.

Referring to FIG. 13, the (N-2)th extension decoder 700 may include an (N-3)th extension decoder 705, an (N-2)th enhancement layer decoding unit 710, an (N-2)th inverse transformation unit 720, an (N-2)th addition unit 730, and an (N-2)th band combination unit 740, for example.

Here, the (N-3)th extension decoder 705 decodes an encoding result CLB of the core layer 1000 and a result of encoding the first through (N-3)th extension layers 1010, 1020, 1030, and 1040, shown in FIG. 3.

The (N-2)th enhancement layer decoding unit 710 decodes an encoding result (N-2)th SNR_ELB of the (N-2)th lower SNR enhancement layer 1051 and the (N-2)th higher SNR enhancement layer 1052, and an encoding result (N-2)th BW_ELB of the (N-2)th bandwidth enhancement layer 1053, which are included in the (N-2)th extension layer 1050, so as to output an (N-2)th SNR enhancement signal and an (N-2)th bandwidth enhancement signal.

The (N-2)th inverse transformation unit 720 inversely transforms the (N-2)th SNR enhancement signal and the (N-2)th bandwidth enhancement signal decoded by the (N-2)th enhancement layer decoding unit 710 from the frequency domain to the time domain.

The (N-2)th addition unit 730 adds the (N-2)th SNR enhancement signal inversely transformed by the (N-2)th inverse transformation unit 720 to a reconstructed signal output from the (N-3)th extension decoder 705, so as to output an (N-2)th addition signal OUT_2.

The (N-2)th band combination unit 740 combines the (N-2)th bandwidth enhancement signal inversely transformed by the (N-2)th inverse transformation unit 720 and the (N-2)th addition signal OUT_2 output from the (N-2)th addition unit 730 so as to output an (N-2)th enhancement signal OUT_1. For example, the (N-2)th band combination unit 740 may combine the (N-2)th bandwidth enhancement signal and the (N-2)th addition signal OUT_2 by using an IQMF method, noting that alternatives are also available.

Figure 14:
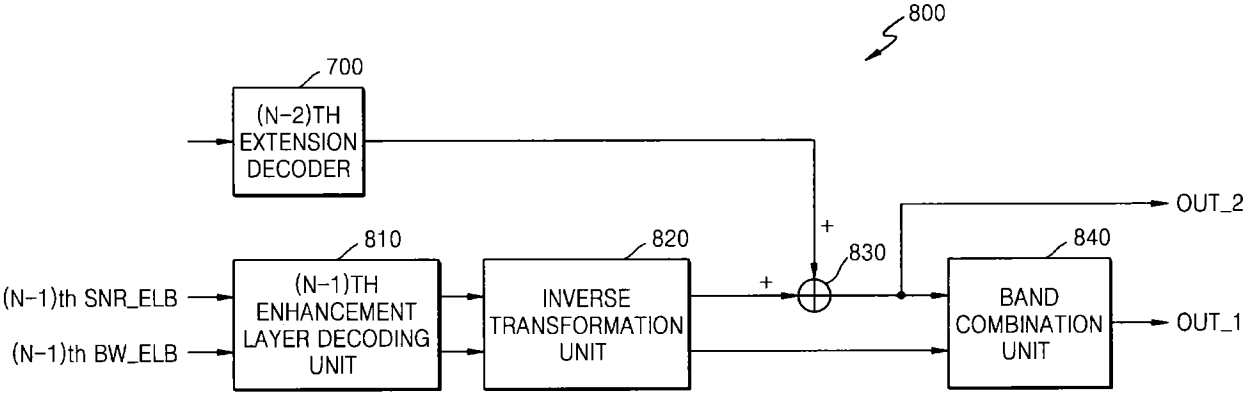
FIG. 14 illustrates a scalable decoding system, according to an embodiment of the present invention.

FIG. 14 illustrates a scalable decoding system 800, according to an embodiment of the present invention. Below, FIG. 14 will also be described in conjunction with FIG. 3, noting that embodiments of the present invention are not limited to the same.

Referring to FIG. 14, the scalable decoding system 800 may include an (N-2)th extension decoder 700, an (N-1)th enhancement layer decoding unit 810, an inverse transformation unit 820, an addition unit 830, and a band combination unit 840, for example.

As illustrated in FIG. 13, the (N-2)th extension decoder 700 decodes an encoding result CLB of the core layer 1000 and a result of encoding the first through (N-2)th extension layers 1010, 1020, 1030, 1040, and 1050, shown in FIG. 3.

The (N-1)th enhancement layer decoding unit 810 may decode an encoding result (N-1)th SNR_ELB of the (N-1)th lower SNR enhancement layer 1061 and the (N-1)th higher SNR enhancement layer 1062, and an encoding result (N-1)th BW_ELB of the (N-1)th bandwidth enhancement layer 1063, which are included in the (N-1)th extension layer 1060, so as to output an (N-1)th SNR enhancement signal and an (N-1)th bandwidth enhancement signal.

Here, the inverse transformation unit 820 inversely transforms the (N-1)th SNR enhancement signal and the (N-1)th bandwidth enhancement signal decoded by the (N-1)th enhancement layer decoding unit 810 from the frequency domain to the time domain.

The addition unit 830 adds the (N-1)th SNR enhancement signal inversely transformed by the inverse transformation unit 820 to a reconstructed signal output from the (N-2)th extension decoder 700, so as to output an (N-1)th addition signal OUT_2.

The band combination unit 840 combines the (N-1)th bandwidth enhancement signal inversely transformed by the inverse transformation unit 820 and the (N-1)th addition signal OUT_2 output from the addition unit 830 so as to output an (N-1)th enhancement signal OUT_1. For example, the band combination unit 840 may combine the (N-1)th bandwidth enhancement signal and the (N-1)th addition signal OUT_2 by using an IQMF method, noting that alternatives are also available.

As described above, a system scalably decoding audio/speech, according to one or more embodiments of the present invention, may include an extension decoder, an enhancement layer decoding unit, an inverse transformation unit, and a band combination unit, for example. In this case, the extension decoder may decode a received bitstream into a core layer and a plurality of extension layers. Thus, the scalable decoding system may have a scalable structure as illustrated in FIGS. 11 through 13.

Figure 15:
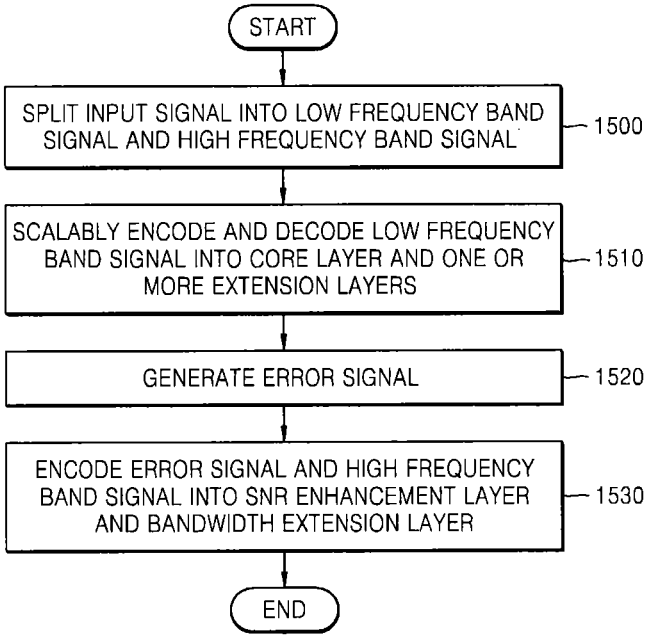
FIG. 15 illustrates a scalable encoding method, according to an embodiment of the present invention.

FIG. 15 illustrates a scalable encoding method, according to an embodiment of the present invention. As only one example, such an embodiment may correspond to example sequential processes of the example scalable encoding system 100 illustrated in FIG. 1, but is not limited thereto and alternate embodiments are equally available. Regardless, this embodiment will now be briefly described in conjunction with FIG. 1, with repeated descriptions thereof being omitted.

Referring to FIG. 15, in operation 1500, an input signal is split into a low frequency band signal that is lower than a predetermined frequency and a high frequency band signal that is higher than the predetermined frequency, e.g., by the band splitting unit 110.

In operation 1510, the split low frequency band signal may be scalably encoded into a core layer and one or more extension layers and then the encoded core layer and the encoded extension layers may be decoded, e.g., by the (N-2)th extension encoder/decoder 200.

In operation 1520, an error signal may be generated by using the split low frequency band signal and a decoded signal of the encoded core layer and the encoded extension layers, e.g., by the error signal generation unit 120.

In operation 1530, the error signal and the high frequency band signal may be encoded into an SNR enhancement layer and a bandwidth extension layer, e.g., by the (N-1)th enhancement layer encoding unit 140.

Figure 16:
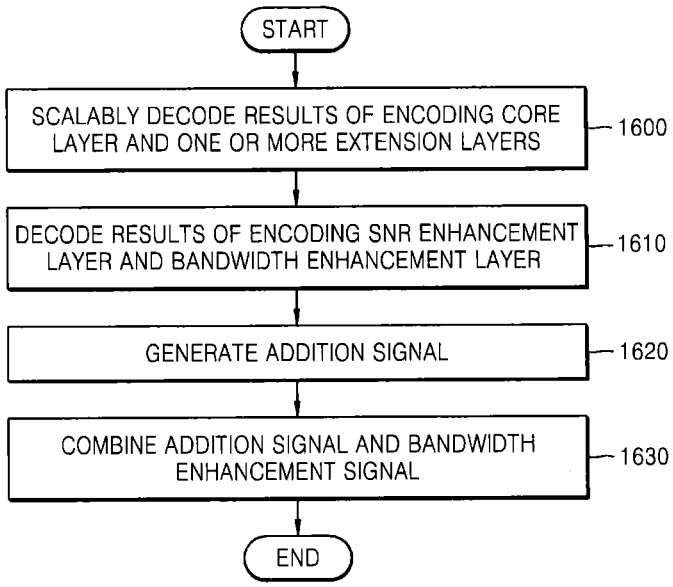
FIG. 16 illustrates a scalable decoding method, according to an embodiment of the present invention.

FIG. 16 illustrates a scalable decoding method, according to an embodiment of the present invention. As only one example, such an embodiment may correspond to example sequential processes of the example scalable decoding system 800 illustrated in FIG. 14, but is not limited thereto and alternate embodiments are equally available. Regardless, this embodiment will now be briefly described in conjunction with FIG. 14, with repeated descriptions thereof being omitted.

Referring to FIG. 16, in operation 1600, results of an encoding of a core layer and one or more extension layers, which may be included in a result of encoding an input signal, may be scalably decoded, e.g., by the (N-2)th extension decoder 700.

In operation 1610, an SNR enhancement signal and a bandwidth enhancement signal may be reconstructed by decoding results of encoding an SNR enhancement layer and a bandwidth enhancement layer, which may further be included in the result of encoding the input signal, e.g., by (N-1)th enhancement layer decoding unit 810.

In operation 1620, an addition signal is generated by adding the reconstructed SNR enhancement signal to a reconstructed signal of the core layer and the extension layers, e.g., by the addition unit 830.

In operation 1630, the addition signal and the bandwidth enhancement signal are combined, e.g., by the band combination unit 840.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as media carrying or including carrier waves, as well as elements of the Internet, for example. Thus, the medium may be such a defined and measurable structure including or carrying a signal or information, such as a device carrying a bitstream, for example, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

As described above, according to one or more embodiments of the present invention, the sound quality of audio/speech may be improved by scalably encoding/decoding the audio/speech.

While aspects of the present invention has been particularly shown and described with reference to differing embodiments thereof, it should be understood that these exemplary embodiments should be considered in a descriptive sense only and not for purposes of limitation. Descriptions of features or aspects within each embodiment should typically be considered as available for other similar features or aspects in the remaining embodiments.

Thus, although a few embodiments have been shown and described, it would be appreciated by those skilled in the art that changes may be made in these embodiments without departing from the principles and spirit of the invention, the scope of which is defined in the claims and their equivalents.

What is claimed is:

1. A method for scalably encoding an input audio/speech signal, the method comprising:

encoding, performed by using at least one processing device, a core layer signal associated with a core bandwidth, from the input audio/speech signal;

encoding, performed by using at least one processing device, one or more enhancement layer signal associated with one or more extended bandwidth, respectively, from the input audio/speech signal;

generating a bitstream by multiplexing the encoded core layer signal and the one or more encoded enhancement layer signal; and transmitting the bitstream to a decoding side, wherein the encoding one or more enhancement layer signal comprises:

obtaining one or more extension signal from the core bandwidth and the one or more extended bandwidth;

transforming the one or more extension signal from a time domain into a frequency domain; and generating the one or more encoded enhancement layer signal by encoding the one or more transformed extension signal.

2. The method of claim 1 further comprising:

decoding the encoded core layer signal and the one or more encoded enhancement layer signal;

generating an error signal by using the decoded core layer signal and the one or more decoded enhancement signal; and encoding the error signal into one or more signal-to-noise ratio (SNR) enhancement layer signal.

3. The method of claim 2, wherein the generating of the error signal comprises generating the error signal by subtracting the decoded core layer signal and the one or more decoded enhancement layer signal from the one or more enhancement layer signal.

4. The method of claim 3, further comprising transforming the error signal from the time domain to the frequency domain, wherein the encoding of the error signal comprises encoding the transformed error signal into the one or more SNR enhancement layer signal.

5. A method for scalably decoding an audio/speech signal, the method comprising:

receiving a bitstream transmitted from an encoding side, the bitstream including an encoded core layer signal and one or more encoded enhancement layer signal;

decoding, performed by using at least one processing device, the encoded core layer signal associated with a core bandwidth;

decoding, performed by using at least one processing device, the one or more encoded enhancement layer signal associated with one or more extended bandwidth, respectively; and reconstructing a bandwidth extended signal for reproduction, based on the decoded core layer signal and the one or more decoded enhancement layer signal, wherein the decoding the one or more encoded enhancement layer comprises:

decoding one or more encoded extension signal from the core bandwidth and the one or more extended bandwidth, included in the bitstream;

transforming the one or more decoded extension signal from a frequency domain into a time domain; and generating the one or more transformed extension signal as the one or more decoded enhancement layer signal.

6. The method of claim 5 further comprising:

decoding one or more encoded SNR enhancement layer signal, included in the bitstream; and adding the one or more decoded SNR enhancement signal to the decoded core layer signal and the one or more decoded enhancement layer signal.

7. A non-transitory computer readable recording medium having recorded thereon a computer program for executing the method of claim 5.

8. The non-transitory computer readable recording medium of claim 7, further comprising:

decoding one or more encoded SNR enhancement layer signal, included in the bitstream; and adding the one or more decoded SNR enhancement signal to the decoded core layer signal and the one or more decoded enhancement layer signal.

9. A system for scalably encoding an input audio/speech signal, the system comprising:

at least one processing device configured to:

encode a core layer signal associated with a core bandwidth, from the input audio/speech signal;

encode one or more enhancement layer signal associated with one or more extended bandwidth, respectively, from the input audio/speech signal;

generate a bitstream by multiplexing the encoded core layer signal and the one or more encoded enhancement layer signal; and transmit the bitstream to a decoding side, wherein the processing device is configured to:

obtain one or more extension signal from the core bandwidth and the one or more extended bandwidth;

transform the one or more extension signal from a time domain into a frequency domain; and generate the one or more encoded enhancement layer signal by encoding the one or more transformed extension signal.

10. The system of claim 9, wherein the processing device is further configured to:

decode the encoded core layer signal and the one or more encoded enhancement layer signal;

generate an error signal by using the decoded core layer signal and the one or more decoded enhancement signal; and encode the error signal into one or more signal-to-noise ratio (SNR) enhancement layer signal.

11. A system for scalably decoding an audio/speech signal, the system comprising:

at least one processing device configured to:

receive a bitstream transmitted from an encoding side, the bitstream including an encoded core layer signal and one or more encoded enhancement layer signal;

decode the encoded core layer signal associated with a core bandwidth;

decode the one or more encoded enhancement layer signal associated with one or more extended bandwidth, respectively; and reconstruct a bandwidth extended signal for reproduction, based on the decoded core layer signal and the one or more decoded enhancement layer signal, wherein the processing device is configured to:

decode one or more encoded extension signal from the core bandwidth and the one or more extended bandwidth, included in the bitstream;

transform the one or more decoded extension signal from a frequency domain into a time domain; and generate the one or more transformed extension signal as the one or more decoded enhancement layer signal.

12. The system of claim 11, wherein the processing device is further configured to:

decode one or more encoded SNR enhancement layer, included in the bitstream;

add the one or more decoded SNR enhancement signal to the decoded core layer and one or more decoded enhancement layer signal.

* * * * *